US009826308B2

(12) United States Patent
Hogan et al.

(10) Patent No.: US 9,826,308 B2
(45) Date of Patent: Nov. 21, 2017

(54) CAPACITIVE DISPLACEMENT SENSING CIRCUIT WITH A GUARD VOLTAGE SOURCE

(71) Applicant: Apple Inc., Cupertino, CA (US)

(72) Inventors: Roderick B. Hogan, San Francisco, CA (US); Scott P. Porter, Cupertino, CA (US); Ruchir M. Dave, San Jose, CA (US)

(73) Assignee: APPLE INC., Cupertino, CA (US)

( * ) Notice: Subject to any disclaimer, the term of this patent is extended or adjusted under 35 U.S.C. 154(b) by 146 days.

(21) Appl. No.: 14/839,228

(22) Filed: Aug. 28, 2015

(65) Prior Publication Data

US 2016/0241957 A1 Aug. 18, 2016

Related U.S. Application Data

(60) Provisional application No. 62/115,430, filed on Feb. 12, 2015.

(51) Int. Cl.
*H04R 3/00* (2006.01)
*H04R 9/06* (2006.01)

(52) U.S. Cl.
CPC ..... *H04R 3/007* (2013.01); *H04R 9/06* (2013.01)

(58) Field of Classification Search
None
See application file for complete search history.

(56) References Cited

U.S. PATENT DOCUMENTS

| | | | | |
|---|---|---|---|---|
| 6,145,384 | A | 11/2000 | Ikeda et al. | |
| 7,898,818 | B2 | 3/2011 | Kehoe | |
| 9,049,523 | B2 * | 6/2015 | Bose | G01D 5/2417 |
| 9,241,227 | B2 * | 1/2016 | Yamkovoy | G01D 5/2417 |
| 2009/0095081 | A1 | 4/2009 | Nakatani | |
| 2012/0104898 | A1 * | 5/2012 | Qu | H04R 19/005 310/319 |
| 2013/0082618 | A1 | 4/2013 | Hussain et al. | |

OTHER PUBLICATIONS

Tomasz, Martin, "Use Analog Techniques to Measure Capacitance in Capacitive Sensors", *Electronic Design*, Retrieved via internet on Feb. 14, 2015, (Nov. 13, 2012), 8.

* cited by examiner

*Primary Examiner* — Paul Huber
(74) *Attorney, Agent, or Firm* — Blakely, Sokoloff, Taylor & Zafman LLP

(57) ABSTRACT

A common plate is formed in a moveable element of a device, the device having an actuator coupled to drive the moveable element. A first plate and the common plate together form a first capacitance, while a second plate and the common plate together form a second capacitance, both of which varies as a function of displacement of the moveable element. A measurement circuit has an input coupled to the first plate, while an excitation voltage source has an output coupled to the second plate. A guard voltage source has an output coupled to a conductive portion of the device. Other embodiments are also described and claimed.

17 Claims, 3 Drawing Sheets

CAPACITIVE DISPLACEMENT SENSING CIRCUIT WITH A GUARD VOLTAGE SOURCE

This non-provisional application claims the benefit of the earlier filing date of provisional application No. 62/115,430 filed Feb. 12, 2015.

An embodiment of the disclosure relates to electronically sensing displacement of a moving element, using a capacitive sensor, and more particularly to sensing displacement of a diaphragm of a speaker. Other embodiments are also described.

BACKGROUND

Capacitive sensors can be used to measure displacement accurately, by exhibiting a change in capacitance as a function of relative displacement of the two conductive plates that form a capacitance. Typically, the capacitive sensor is constructed using precision metal plates that are in close proximity, while an electric field is maintained between them. In many cases, the resulting variable capacitance is usually relatively small, for example on the order of less than 10 picoFarads but may depend widely on the geometry of the sensor. A measuring circuit is coupled to the plates and produces an output signal that represents a measure of the capacitance. Typical measuring circuits include the use of an analog timer integrated circuit to generate an oscillating signal whose frequency varies as a function of, and is inversely proportional to, the capacitance to be measured. A micro controller can then be used to count pulses, in response to the oscillating signal, within a given period, which translates into the frequency of the oscillating signal and hence the capacitance. The conventional measurement circuit has well known limitations that result in an error in the measured capacitance. The error may be caused by the existence of parasitic capacitance on the input pins of the timer integrated circuit (which are coupled to the capacitance to be measured). The parasitic capacitance erroneously adds to the measured capacitance value. The effects of parasitic capacitance on the input pins of the timer integrated circuit may be compensated for by electronic subtraction using passive or active compensation devices.

Other techniques for measuring a variable capacitance include an operational amplifier (op amp) integrator approach in which the op amp drives a precision current into the capacitor, and determines the capacitance by assessing an integration time. With that approach, the input pin capacitance of the op amp used for integration remains at a virtual ground, thereby relieving any concerns with parasitic capacitance on the input pin.

SUMMARY

An embodiment of the disclosure is a capacitive displacement sensing circuit having first and second capacitances that are coupled in series through a common plate, where both the first capacitance and the second capacitance vary as a function of displacement of a moveable element in which the common plate is formed. A measurement circuit has an input coupled to the first plate, while an excitation voltage source has an output coupled to the second plate. A guard voltage source has an output that is coupled to a conductive portion of a device of which the moveable element is a part. The device may, for example, be a speaker in which the moveable element is a diaphragm of the speaker and an actuator such as a voice coil motor is coupled to drive the moveable element. An output of the measuring circuit produces a signal (e.g., a voltage signal) that represents the measured "effective" capacitance, being the series coupling of the first and second capacitances, which in turn translates into the displacement of the moveable element. The guard voltage source is designed to produce a voltage at its output that helps make the measurement insensitive to the parasitic capacitance that appears on the common plate (relative to circuit ground).

The above summary does not include an exhaustive list of all aspects of the present disclosure. It is contemplated that the disclosure includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the disclosure are illustrated by way of example and not by way of limitation in the figures of the accompanying drawings in which like references indicate similar elements. It should be noted that references to "an" or "one" embodiment of the disclosure are not necessarily to the same embodiment, and they mean at least one. Also, in the interest of conciseness or reducing the total number of drawings, a given figure may be used to illustrate the features of more than one embodiment of the disclosure, and not all elements in the figure may be required for a given embodiment.

DETAILED DESCRIPTION

Several embodiments of the disclosure with reference to the appended drawings are now explained. Whenever the shapes, relative positions and other aspects of the parts described in the embodiments are not explicitly defined, the scope of the disclosure is not limited only to the parts shown, which are meant merely for the purpose of illustration. Also, while numerous details are set forth, it is understood that some embodiments of the disclosure may be practiced without these details. In other instances, well-known circuits, structures, and techniques have not been shown in detail so as not to obscure the understanding of this description.

Figure 1A:
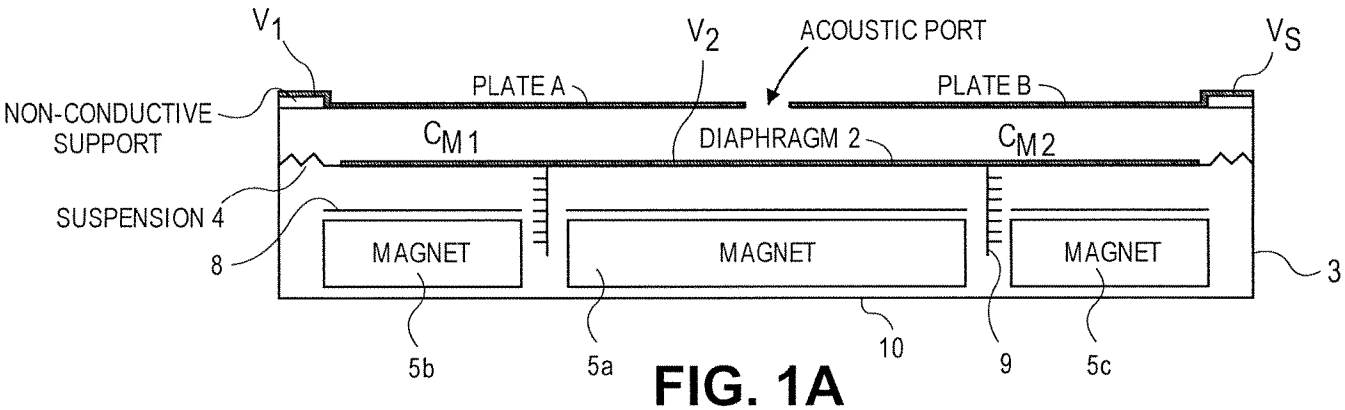
FIG. 1A is a block diagram of a device in which a capacitive displacement sensing circuit, in accordance with an embodiment of the disclosure, can be used.

As introduced above, an embodiment of the disclosure includes a capacitive displacement sensing circuit that can be used to measure a variable capacitance that represents displacement of a moveable element, as part of a larger device. FIG. 1A depicts an example of the larger device being or containing a speaker such as a consumer electronic audio device having a loudspeaker. The speaker has a sound radiating diaphragm 2 whose displacement relative to fixed capacitor plates, Plate A and Plate B, is to be measured. While an embodiment of the disclosure is described below in connection with sensing displacement of a diaphragm, the approach for displacement sensing described here is also applicable to other devices in which a moveable element is driven by an actuator and where a quantitative, absolute measure of the displacement of the moveable element is desired. Returning to FIG. 1A, the capacitor plates A and B define series coupled capacitances $C_{M1}$ and $C_{M2}$ where $C_{M1}$ is the capacitance between Plate A and a conductive plate or surface in the diaphragm 2 (also referred to as a common plate) while $C_{M2}$ is the capacitance formed between the common plate and Plate B. Couplings are made from a measurement circuit 6 (see FIG. 1B) to Plate A at node $V_1$ (exhibiting voltage $V_1$), and from an excitation voltage source 7 to Plate B (at node $V_S$ or exhibiting voltage $V_S$), to obtain a signal $V_O$ that represents the effective combined capacitance $C_M$. The common plate on the diaphragm 2 may be electrically floating and is indicated to be at node $V_2$ (or exhibiting voltage $V_2$). The diaphragm 2 is attached to a non-conductive frame 3 through a suspension 4, and where the frame 3 may also contain a magnet system having, in this case, a center magnet 5*a* and two side magnets 5*b*, 5*c*. In the case of FIG. 1A, the magnet system may have one or more pole pieces 8 that serve to guide or shape the magnetic flux within a gap in which a voice coil 9 is positioned as shown. A yoke 10 may also be included to provide magnetic field paths to the various magnets in order to enhance the flux within the gap, where it is understood that the yoke 10, as well as the pole piece 8 may be made of a ferromagnetic, conductive material such as iron. The voice coil 9 is attached to, in this case, a bottom face of the diaphragm 2 and will receive an audio signal (not shown) in response to which the voice coil is energized and the voice coil current will interact with the magnetic field produced by the magnet system, thereby resulting in forcing movement of the diaphragm 2 to produce sound, in accordance with the audio signal. An acoustic port serving as a primary acoustic output port of the speaker is shown as being positioned above the front face of the diaphragm 2, in a "front firing" configuration. An alternative to the front firing configuration is a side-firing configuration (not shown) where the acoustic port may be located such that the sound waves emanating from the front face of the diaphragm 2 are turned and forced to exit the front volume chamber of the speaker (which is volume between the diaphragm 2 and the plates, A, B) in a horizontal direction as opposed to the vertical direction as shown in FIG. 1A. Other magnet system designs and more complicated acoustic designs are possible, including situations that call for more than one pair of capacitor plates A, B whose capacitance is to be measured.

Figure 1B:
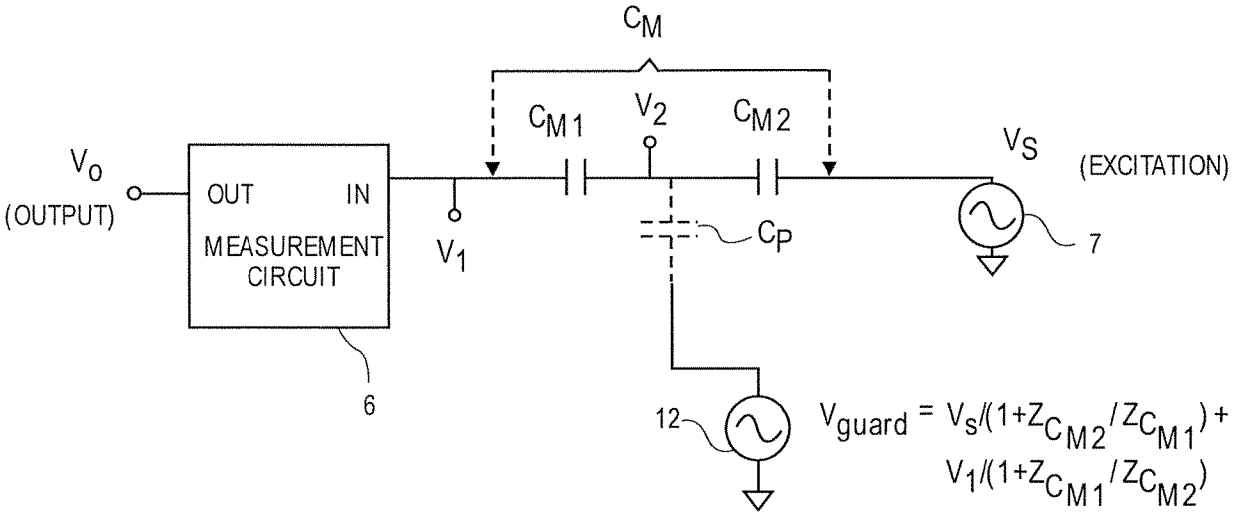
FIG. 1B is a schematic of a capacitive displacement sensing circuit, according to an embodiment of the disclosure.

Turning now to FIG. 1B, this is a schematic of an embodiment of the capacitive displacement sensing circuit that may be viewed, in a general sense, in relation to other devices in which the circuit is implemented, or specifically in connection with the embodiment of FIG. 1A (namely in a speaker device.) In a general sense, the schematic in FIG. 1B shows a measurement circuit 6 having an input that is coupled to a first plate, which is the left-hand plate of capacitor $C_{M1}$, while a second plate which is the right-hand plate of capacitor $C_{M2}$ is coupled to an output of an excitation voltage source 7 (at a node having voltage $V_S$). The right hand plate of $C_{M1}$ and the left hand plate of $C_{M2}$ form a common plate as shown, where the first plate and the common plate together form the first capacitance $C_{M1}$ (which varies as a function of displacement of the moveable element, or as understood here the common plate), while the second plate and the common plate together form a second capacitance $C_{M2}$ that also varies as a function of the displacement of the common plate. The common plate is at a node having voltage $V_2$, whereas the first plate is at a node having voltage $V_1$ and the second plate is at a node having voltage $V_S$. The effective capacitance, being the series coupling of $C_{M1}$ and $C_{M2}$, is referred to here as $C_M$.

FIG. 1B also shows the presence of parasitic capacitance $C_P$ which will be described in connection with subsequent figures as $C_{P2}$ due to the presence of other parasitic capacitance $C_{P1}$ and $C_{P3}$. In accordance with an embodiment of the disclosure, a guard voltage source 12 that produces a voltage $V_{guard}$ at its output is coupled to a conductive portion of the device in which the capacitive displacement sensing circuit (including the common plate in the example diaphragm 2 of FIG. 1A) is being implemented. For example, in one embodiment, the guard voltage source $V_{guard}$ may be directly coupled to a conductive part of the actuator (e.g., a motor of a speaker) that moves the common plate, and whose area is preferably as great as that of the common plate. As an example, the coupling (e.g., a direct electrical connection or short) may be to the pole piece 8 of the magnet system of a speaker motor, and more preferably to the yoke 10 of the speaker depicted in FIG. 1A. The understanding here is that the parasitic capacitance formed between the common plate (at node $V_2$) and circuit ground (to which the guard voltage source $V_{guard}$ is coupled) can be "captured" by making a coupling to the pole piece 8 or more preferably the yoke 10 of the magnet system, where the yoke 10 is preferred because it has greater area than a pole piece 8 and, as a result, can better represent the bottom plate of the parasitic capacitance $C_P$. In other words, the guard voltage source 12 is connected to what may be viewed as the bottom plate of the parasitic capacitance $C_P$ (see FIG. 1B). It may also be noted that the magnet and pole pieces of a speaker are typically smaller than the area of its diaphragm and as such, the pole pieces may not be as effective a location for applying the guard voltage $V_{guard}$ to the device. An explanation of this solution, namely why the guard voltage so connected may serve to reduce sensitivity to $C_P$, is now given.

Figure 2:
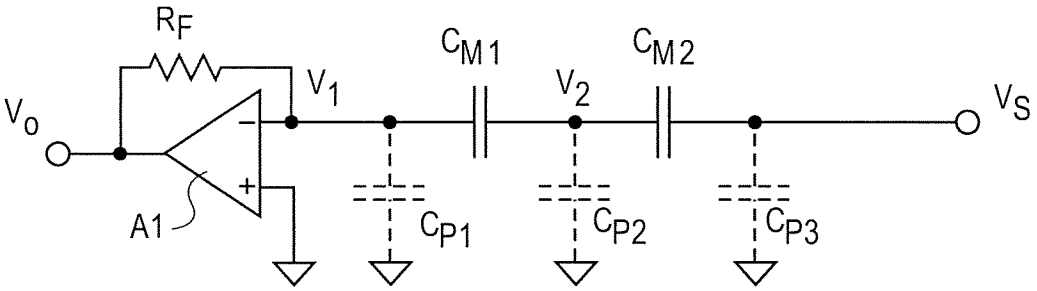
FIG. 2 is a schematic of an example sensing circuit in which a measurement circuit uses a negative feedback closed loop configured op amp to produce a virtual ground at the first plate of a capacitor structure.

Now referring to FIG. 2, this is an example schematic of a capacitive displacement circuit in which a particular example of the measurement circuit 6 is used to obtain the output voltage $V_O$ (which provides a measure of the unknown, variable capacitance). An excitation is applied at node $V_S$, where this excitation may be a pure sinusoid or it may be a square wave or other time varying waveform having a fundamental frequency that is selected in view of the expected value of the effective capacitance $C_M$. The measurement circuit 6 has an amplifier A1 that has a feedback element $R_F$, in this case a feedback resistor but alternatively another type of passive or active circuit that provides feedback from the output to the inverting input (−) of A1. Note that amplifier A1 may be an op amp, where the term op amp is used generically here to refer to any suitable high gain amplifier that can be coupled to form a lower gain but stable, closed loop amplifier. This configuration of the amplifier A1 results in a virtual ground being formed at node $V_1$, due to the non-inverting input (+) of the amplifier A1 being coupled to ground. This is an example where the amplifier A1 may be operated using a dual power supply system containing positive and negative power supply voltages (not shown). As an alternative, a single supply arrangement may be used to power the amplifier A1, where in that case the non-inverting (+) input may be coupled to a mid supply voltage. Other reference voltages may also be set at the non-inverting input.

The capacitance to be measured may be viewed as the combined series capacitance of $C_{M1}$ and $C_{M2}$, namely $C_M$ which is given by $$\frac{1}{C_M} = \frac{1}{C_{M2}} + \frac{1}{C_{M1}} \quad \text{(Equation 1)}$$

In one embodiment, $C_{M1}$ and $C_{M2}$ are designed to be essentially equal, with equal area and equal distance (distance between Plate A and the common plate and distance between Plate B and the common plate—see FIG. 1A). That configuration is particularly suitable for implementation in a speaker, where the diaphragm may be expected to be fairly flat, such that the distance under Plate B is essentially the same as the distance under Plate A (as measured directly vertically down to the diaphragm below). Under those assumptions, the following relationship may be derived using circuit network theory:

$$(C_{M1}+C_{M2})/(C_{M1}*C_{M2})=(V_S/V_O)/(2*\pi*f_s) \quad \text{(Equation 2)}$$

where $f_s$ is the fundamental frequency of the excitation source voltage $V_S$. As an example only, $f_s$ may be set to 1 MHz, $R_F$ may be set to 100,000 Ohms, and $V_S$=1 $Volt_{rms}$, which yields $C_{M1}$=$C_{M2}$=5 picoFarads and $V_O$=1.57 volts (rms). It is expected that in some applications of the capacitive displacement sensing circuit here in the context of speaker devices, $C_{M1}$, $C_{M2}$ will each be less than 10 picoFarads.

Figure 3:
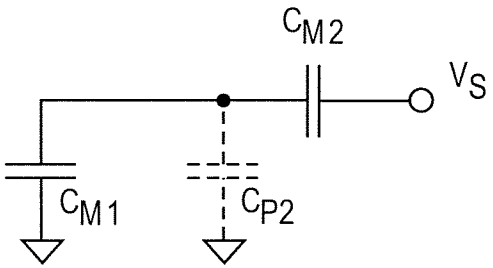
FIG. 3 is an ac circuit model of the embodiment of FIG. 2.

Still referring to FIG. 2, this schematic illustrates the presence of three types of parasitic capacitances, $C_{P1}$, $C_{P2}$ and $C_{P3}$. The effects of $C_{P1}$ and $C_{P3}$ on the measurement may be neglected, because of the presence of the excitation voltage source $V_5$ which maintains a fixed voltage at the right-side plate of $C_{M2}$, while the measurement circuit through operation of the negative closed loop arrangement around the amplifier A1 maintains a virtual ground at node $V_1$ (the left-hand plate of $C_{M1}$). This, however, leaves the common plate (node $V_2$) susceptible to the parasitic capacitance $C_{P2}$ (or simply $C_P$ as depicted in the diagram of FIG. 1B). The presence of $C_{P2}$ is a problem, because it is comparable to the expected range of capacitance for $C_{M1}$ and $C_{M2}$. The presence of $C_{P2}$ is a significant source of error as can be seen from FIG. 3 which is an ac model of the circuit in FIG. 2, where if $C_{P2}$ is comparable, for example, $1/10^{th}$ as large as $C_{M1}$, then a significant error in measurement is produced, because the output voltage Vout will no longer represent a measure of only the series coupled capacitors $C_{M1}$, $C_{M2}$, and instead will also represent a contribution of $C_{P2}$. That contribution may be variable as between devices, and it may not be easily removed through any offset removal or calibration procedure. Accordingly, a technique is needed to improve the accuracy of capacitance measurement by somehow nullifying (reducing the impact of) the effect of the parasitic capacitance $C_{P2}$.

Now, it is instructive to note that if it can be assumed that $C_{M1}$ and $C_{M2}$ have equal capacitance, the voltage at $V_2$ would be one-half of the voltage at $V_S$ (relative to $V_1$) when neglecting the effects of $C_{P2}$ (or essentially assuming that $C_{P2}$ is absent or nonexistent). In accordance with an embodiment of the disclosure, the effect of $C_{P2}$ may be essentially eliminated from the measurement, by driving the bottom plate of $C_{P2}$ (see FIG. 1B) with a signal $V_{guard}$ that may be equal to one-half that of $V_S$. If the bottom plate of this parasitic capacitance were not driven to $V_{guard}$ in this manner, then it would be deemed grounded and thereby causing an error in the measurement.

Figure 4:
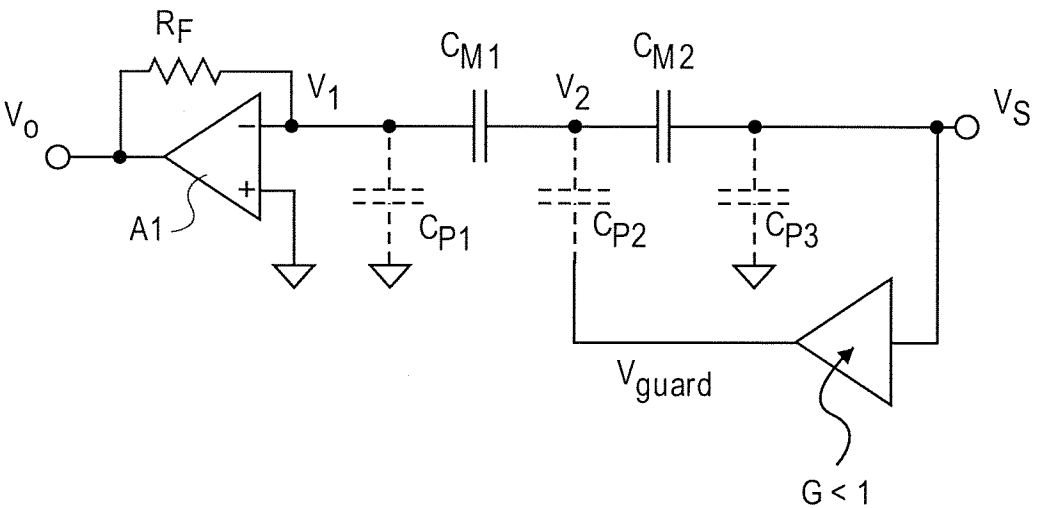
FIG. 4 is a schematic of the sensing circuit depicted in FIG. 2 with the addition of a guard voltage source to reduce sensitivity of the measurement to the parasitic capacitance $C_{P2}$.

In the example shown in FIG. 4, the guarding signal $V_{guard}$ is produced by a guard voltage source 12 that is implemented using a linear amplifier whose gain G (voltage gain) is less than one, such that the guard voltage source produces an ac voltage, e.g., having a time varying waveform that is similar to that of the excitation voltage source 7, whose rms value is a fraction of the rms value of the ac voltage Vs produced by the excitation voltage source 7. As an alternative, $V_{guard}$ could be generated independently of the excitation voltage source 7. In one example, the rms value of the output of the guard voltage source ($V_{guard}$) may be designed (predetermined) to be within +/−1% of the rms value of the voltage of the common plate V2, when the parasitic capacitance CP2 (or CP in FIG. 1B) is neglected. These voltages may be measured in a laboratory and the amplitude of the desired guard voltage source may then be set accordingly and may remain fixed during in-the-field use of the device.

In the above example, it was assumed that $C_{M1}$=$C_{M2}$, such that the two capacitors form in effect a voltage divider at $V_2$ which produces a voltage that is one-half the voltage at $V_S$ (assuming that $V_1$ is at virtual ground). More generally, however, $C_{M1}$ need not be equal to $C_{M2}$ for the techniques described here to applicable. In general, neglecting the presence of $C_{P2}$, the following equation my be written $$V_2=V_S/(1+Z_{C_{M2}}/Z_{C_{M1}})+V_1/(1+Z_{C_{M1}}/Z_{C_{M2}}) \quad \text{(Equation 3)}$$

where $V_1$ need not be at virtual ground, and $Z_{CM1}$ is the complex impedance presented by the capacitance $C_{M1}$, while $Z_{CM2}$ is the complex impedance presented by the capacitance $C_{M2}$. A further simplification of the Equation 3 above leads to $$V_2=V_S/(1+C_{M1}/C_{M2})+V_1/(1+C_{M2}/Z_{M1}) \quad \text{(Equation 4)}$$

It can bee seen from Equation 4 above that when $V_1$ is at virtual ground (0 volts), the Equation 4 reduces to Equation 5 below, which is the desired guard voltage $V_{guard}$ that should be applied in the embodiment of FIG. 4.

$$V_2=V_S/(1+C_{M1}/C_{M2}) \quad \text{(Equation 5)}$$

The equations above reveal that the guard voltage may be a fraction of the excitation voltage $V_S$, the fraction being proportional to $1/(1+C_{ratio})$ where $C_{ratio}$ is a ratio of the first capacitance $C_{M1}$ to the second capacitance $C_{M2}$. The values for $C_{M1}$ and $C_{M2}$ may be measured in a laboratory setting, and the guard voltage may be then set at the laboratory. Since the variation in $C_{M1}$ and $C_{M2}$ may be assumed to be the same during movement of the common plate (moveable element), keeping the fractional gain of the amplifier G in FIG. 4 fixed is effective in maintaining the desired guard voltage that will essentially nullify the effect of $C_{P2}$ on the common plate node $V_2$.

While the output voltage $V_O$ of the measurement circuit (see FIG. 1B) represents the combined effective capacitance $C_M$ (being the series combination of $C_{M1}$ and $C_{M2}$), an actual displacement value may be computed by, for example, a digital microcontroller that digitizes the analog voltage at $V_O$ and converts the digital value using a simple formula into a number that is in true displacement units (e.g., millimeters). This formula may be derived at the laboratory using the known definition of capacitance as a function of the distance between the plates of a capacitor, and a function of the effective area of the plates. The value of $C_M$ may then be computed, depending upon the technique used in the measurement circuit. In the particular example of FIG. 4, the value of $C_M$ may be given by the following equation $$Z_{CM} = \frac{V_S}{V_O} * R_F \quad \text{(Equation 6)}$$

where $Z_{CM}$ is the impedance of the effective capacitance $C_M$ presented by the series combination of $C_{M1}$ and $C_{M2}$. Once again, Equation 6 represents the case where $V_1$ is at virtual ground. In the more general case where $V_1$ is not at ground potential, a more general equation may be written that accounts for a non-zero value for the voltage at node $V_1$.

In accordance with another embodiment of the invention, a method for capacitive displacement sensing may be proceed as follows. A first ac voltage signal is generated on a second plate of variable capacitor, while deriving an output voltage from a first plate of the variable capacitor. The variable capacitor has a common plate that is moveable relative to the first plate and/or relative to the second plate, for example as described above in connection with FIG. 1*a* which is the case where the common plate is on a diaphragm of a speaker. The method however is applicable to other implementations of a dual plate, variable capacitor whose capacitance varies as a function of plate displacement or distance. Also as given above in certain examples, the first ac voltage signal may be an excitation produced by a voltage source (e.g., Vs) and may be a pure sinusoid or a square wave, for example. The method for sensing proceeds with generating a second ac voltage signal, on a conductive portion that is electrically insulated from the common plate. The second ac voltage signal is generated simultaneously with the first ac voltage signal, where as described above the second ac voltage signal may be produced by another voltage source, such as the guard voltage source 12 (e.g. $V_{guard}$). The second ac voltage signal may have an rms value that is a predetermined fraction of the rms value of the first ac voltage signal. In other words, the rms value of the second ac voltage signal is smaller than the rms value of the first voltage signal, and may have been set at the time of manufacture of the device in which the method is occurring. The relationship or fraction may depend on several factors as described above, including for example whether the two capacitors (formed by the first and second plates, respectively, against the common plate) are designed to be essentially equal, and also whether or not the first plate is forced to a virtual ground or to some other reference voltage, for example, while deriving the output voltage from the first plate. The process may continue by translating the output voltage (that is derived from the first plate) into a numerical measure of the plate displacement (e.g., displacement of the common plate relative to the first plate and/or relative to the second plate.)

While certain embodiments have been described and shown in the accompanying drawings, it is to be understood that such embodiments are merely illustrative of and not restrictive on the broad disclosure, and that the disclosure is not limited to the specific constructions and arrangements shown and described, since various other modifications may occur to those of ordinary skill in the art. For example, while FIG. 1A depicts the device in which the capacitive displacement sensing circuit may be implemented in an electrodynamic speaker, other types of speakers in which a common plate in the diaphragm moves relative to two fixed plates may also benefit from the displacement sensing circuit, including one where the two plates A, B are located below the diaphragm rather than above it as depicted in FIG. 1A. The description is thus to be regarded as illustrative instead of limiting.

What is claimed is:

1. A capacitive displacement sensing circuit comprising:

a common plate formed in a moveable element of a device, the device having an actuator coupled to drive the moveable element;

a first plate, wherein the first plate and the common plate together form a first capacitance that varies as a function of displacement of the moveable element;

a second plate, wherein the second plate and the common plate together form a second capacitance that varies as a function of the displacement of the moveable element;

a measurement circuit having an input coupled to the first plate;

an excitation voltage source having an output coupled to the second plate; and a guard voltage source having an output coupled to a conductive portion of the device.

2. The capacitive displacement sensing circuit of claim 1 wherein the guard voltage source produces an ac voltage whose rms value is a fraction of the rms value of an ac voltage produced by the excitation voltage source.

3. The capacitive displacement sensing circuit of claim 2 wherein the rms value of the guard voltage source is within +/−1% of the rms value of the voltage of the common plate when parasitic capacitance between the common plate and circuit ground is neglected.

4. The capacitive displacement sensing circuit of claim 2 wherein the fraction is proportional to $1/(1+C_{ratio})$ wherein $C_{ratio}$ is a ratio of the first capacitance to the second capacitance.

5. The capacitive displacement sensing circuit of claim 1 in combination with the device being a speaker, wherein the moveable element is a diaphragm of the speaker and the actuator is a voice coil motor of the speaker.

6. The capacitive displacement sensing circuit of claim 2 in combination with the device being a speaker, wherein the moveable element is a diaphragm of the speaker and the actuator is a voice coil motor of the speaker, and wherein the voice coil motor comprises a magnet system having a magnet and a yoke, and wherein the first and second plates are fixed relative to the diaphragm.

7. The capacitive displacement sensing circuit of claim 6 wherein the conductive portion of the device is part of the voice coil motor.

8. The capacitive displacement sensing circuit of claim 6 wherein the conductive portion of the device comprises or is part of the yoke.

9. The capacitive displacement sensing circuit of claim 6 wherein the conductive portion of the device comprises a pole piece of the magnet system.

10. The capacitive displacement sensing circuit of claim 1 wherein the measurement circuit comprises an operational amplifier and a resistor that couples an output of the operational amplifier to an inverting input while a non-inverting input is coupled to a reference voltage source, and wherein the inverting input is coupled to the first plate.

11. The capacitive displacement sensing circuit of claim 1 wherein the guard voltage source derives its output from the excitation voltage source.

12. The capacitive displacement sensing circuit of claim 1 wherein the excitation voltage source produces an ac voltage being one of a pure sinusoid and a square wave.

13. The capacitive displacement sensing circuit of claim 1 wherein an output of the measurement circuit represents the displacement.

14. An audio device comprising:

a speaker having a diaphragm and a voice coil motor coupled to actuate the diaphragm; and a capacitive displacement sensing circuit having a common plate on the diaphragm, a first plate that forms a first variable capacitance with the common plate, a second plate that forms a second variable capacitance with the common plate, a measurement circuit having an input coupled to the first plate, and an excitation voltage source coupled to the second plate, and a guard voltage source having an output coupled to a conductive portion of the voice coil motor.

15. The audio device of claim 14 wherein the voice coil motor comprises a voice coil and a magnet system having a magnet, a pole piece and a yoke.

16. The audio device of claim 15 wherein the conductive portion is part of the yoke.

17. The audio device of claim 14 wherein the guard voltage source produces an ac voltage whose rms value is a fraction of an rms value of an ac voltage produced by the excitation voltage source.

* * * * *